US006076615A

United States Patent [19]

Dalland et al.

[11] Patent Number: 6,076,615

[45] Date of Patent: Jun. 20, 2000

[54] MULTI-LINKED WORKING BOOM FOR WORKING MACHINE

[76] Inventors: Knut Dalland, N-5240, Valestrandsfossen; Ingvar Osen, N-6815, Bygstad, both of Norway

[21] Appl. No.: 09/029,191

[22] PCT Filed: Aug. 23, 1996

[86] PCT No.: PCT/NO96/00211

§ 371 Date: Mar. 2, 1998

§ 102(e) Date: Mar. 2, 1998

[87] PCT Pub. No.: WO97/08419

PCT Pub. Date: Mar. 6, 1997

[30] Foreign Application Priority Data

Aug. 25, 1995 [NO] Norway ..... 953345

[51] Int. Cl.[7] ..... E21C 11/00

[52] U.S. Cl. ..... 173/42; 173/29; 173/37; 173/185; 173/193

[58] Field of Search ..... 173/193, 194, 173/42, 46, 37, 184, 185, 28, 29; 299/70, 37.4

[56] References Cited

U.S. PATENT DOCUMENTS

| | | | |
|---|---|---|---|
| 2,614,808 | 10/1952 | Curtis et al. | 173/193 |
| 3,586,113 | 6/1971 | Grant | 173/46 |
| 3,724,559 | 4/1973 | Stromnes | 173/193 |
| 3,744,574 | 7/1973 | Carley | 173/46 |
| 3,773,118 | 11/1973 | Shanks et al. | 173/193 |
| 3,982,715 | 9/1976 | Lindgren et al. | 173/193 |
| 4,378,054 | 3/1983 | Bourcier et al. | 173/29 |
| 4,498,544 | 2/1985 | Molin | 173/194 |

FOREIGN PATENT DOCUMENTS 2191990 12/1987 United Kingdom .

*Primary Examiner*—Peter Vo
*Assistant Examiner*—Jim Calve
*Attorney, Agent, or Firm*—Fulbright & Jaworski, LLP

[57] ABSTRACT

The present invention is directed to a multi-linked working boom for a working machine which carries at the other end a hydraulically maneuverable and hydraulically driven working equipment, where the boom comprises a first pair of link arms which is connected to the working machine and a second pair of link arms which is jointed to the first pair of link arms via a link arm-forming support member, which is intermittently fixable against a support foundation by means of the first pair of link arms.

7 Claims, 6 Drawing Sheets

MULTI-LINKED WORKING BOOM FOR WORKING MACHINE

BACKGROUND OF THE INVENTION

Present invention relates to a multi-linked working boom for a working machine, where the boom carries at the outer end a hydraulically manoeuvrable working tool, especially rock drilling equipment, and comprises a first pair of hydraulically manoeuvrable link arms, which are connected to the working machine, and a second pair of hydraulically manoeuvrable link arms, which connect the working tool to the first pair of link arms.

An arrangement of the afore-mentioned kind is shown in SE-B 449 882. There is shown a working tool in the form of a timber grab, where a bunch of timber logs are to be moved in one and the same direction from the collection location to the delivery location by movement of link arms of a working boom in one and the same vertical plane. In addition the working boom can be swung about an extra vertical axis of the working machine. The power means for swinging the working arms is operated with hydraulic oil supplied from the hydraulic system of the working machine. The working boom is shown in the form of a first and a second pair of link arms which serve to increase longitudinally the working area of the working boom via a series of successive link arms. The four link arms illustrated are pivotally mounted about their mutually parallel pivot axes by means of their respective hydraulic pressure cylinders. The working boom is adapted to be able to be supported against the ground by means of a support plate on the under side of the third link arm, reckoned from the working machine, in order thereby to unload via the outer link arms during an introductory timber transport phase portions of the load from the working boom to the ground. In this connection a support plate is arranged on the under side of the middle link of the loading boom. The support plate has however an exclusive function during said introductory transport phase.

Similar working booms are also shown in EP-A1-0 299 104 and in DE-C1 41 32 173 in connection with hydraulically swingable loading shovels, where the working booms are swung in a manner corresponding to the timber grab.

SUMMARY OF THE INVENTION

With the present invention the aim is to provide an arrangement of the afore-mentioned kind which is specifically designed for use in rock drilling operations, where the approach to the problem is different from the pure load grabbing operations. By the fact that the working area is different in rock drilling operations and thereby creates a need for other functions for the working boom than that which can be offered by the known load grabbing operations, the aim according to the invention is to design the working boom in a special, novel way according to the invention. However the objective is a working boom which can also be employed for other working tools than drilling equipment, for example for bolt recovery tools, excavation tools, etc., where the tool requires corresponding working areas and corresponding working conditions as with rock drilling equipment, in order to carry out several successive working operations within a specific working area.

In practice it is in many instances problematical in rock drilling operations, and in similar floor space-demanding working operations, to get suitable access to the working location and often there must be constructed in advance temporary access roads for the working machine. In particular the aim according to the invention is to be able to establish with the aid of the working boom a remotely disposed base for performing a series of working operations within a specific space-limited working area.

According to the invention the afore-mentioned approach to the problem is solved in that the second pair of link arms is joint connected to the first pair of link arms via a link arm-forming support member, that the support member is provided with a stop part or a set of stop parts for intermittently fixing the support member against an arbitrary support base by means of a tension force from the first pair of link arms, and that the second pair of link arms is swingable via the support member in two mutually crossing pivotal planes relative to the first pair of link arms.

With the afore-mentioned equipment one can according to the invention make oneself more or less independent of pre-formed access roads and get entry to working locations otherwise accessible with difficulty and also undertake a series of working operations from one and the same starting location for a remotely disposed working area.

It is consequently possible according to the invention to transfer the working tool/drilling equipment within said working area to various precise working positions by means of the working boom of the working machine and hereby employ the hydraulic system of the working machine for operating the working tool/drilling equipment.

Alternatively the working tool/drilling equipment can be supplied at said remotely disposed working area with pneumatic driving power or other driving power separately or directly from the working machine.

By means of the support member with associated stop member there can be established with one and the same intermittently fixing of the support member to the ground via the first pair of link arms, a stable, stationary starting point for the various working operations and thereby drill for example in a controlled manner a series of bore holes within the reach which is established by the second pair of link arms.

By being able to swing, via the support member, the second pair of link arms in two different pivotal planes relative to the first pair of link arms, there is the possibility of being able to undertake the various working operations in a controlled and effective manner relative to the position where the support member is supported against the ground.

Consequently according to the invention successive working operations can be undertaken, such as drilling a series of bore holes, over a working area, which stretches both longitudinally and transversely of a plane through the first pair of link arms.

The working boom according to the invention is further characterised in that the second pair of link arms are swingable relative to the support member about two separate pivotal axes by means of their respective hydraulically driven power means, the support member in addition being swingable relative to the first pair of link arms about a third pivotal axis by means of a hydraulically driven power means in a first plane through the first pair of link arms, while the second pair of link arms and an associated carrier plate are swingable in pivotal arcs in a second plane at right angles to the first plane, and the second pair of link arms are mutually swingable in a third plane which crosses the second plane.

On the basis of the afore-mentioned possibility for swinging of the second pair of link arms about two crossing axes relative to the support member, it is possible by means of the second pair of link arms of the working boom to move the working tool/rock drilling equipment, in different pivotal arcs relative to the support means, so that rock drilling or like working operations can be undertaken vertically or horizontally or in arbitrary intermediate angular positions, as desired and needed.

Secondly the rock drilling operation and like working operations can be undertaken in series at different distances from the support member, for example along various circular or other arbitrary arcuate lines or along more or less straight, parallel extending or substantially parallel extending lines.

In the afore-mentioned connection the working boom is characterised in that the support member is provided with a power means in the form of a drive motor for turning the carrier plate of the other pair of link arms with associated working tool/rock drilling equipment in the second plane relative to the first plane.

The working tool/rock drilling equipment can hereby be guided in different horizontal and vertical planes in a controlled manner relative to the starting position which is defined by the support member.

Furthermore the aim is to design the working boom in a manner functionally and constructionally favourable during utilisation of the working machine's hydraulic system for operating the drive motor.

The working boom is in this connection characterised in that the support member has a separate hydraulic system for supplying hydraulic oil separately to the power means between the support member and the carrier plate and the one link arm of the second pair of link arms and separately to the power means mutually between the link arms of the second pair of link arms and between the outer link arm and the drilling equipment plus possibly to a power means for operating the drilling equipment, the separate hydraulic system comprising a hydraulic drive motor, which is driven by the hydraulic system of the working machine, while the various hydraulic power means are driven by the drive motor via separate hydraulic circuits having associated separately operable pumps.

The objective is to achieve a functionally favourable solution and in this connection the working boom is characterised in that in the use position the working boom is formed by a first, inner stationary boom member, which comprises the link arms of the first pair of link arms plus the support member, and a second, outer, moveable boom member, which comprises the carrier plate and the link arms of the second pair of link arms, the second boom member forming a moveable support and carrier member for the drilling equipment, while the first boom member forms a stationary support and carrier member for the second boom member.

A further aim is a manually favourable solution and in this connection the working boom is characterised in that the support member, the carrier plate and the second pair of link arms with associated working tool/drilling equipment form a separate construction, which is readily mountable on and dismountable from link arms of the working machine.

Further features of the present invention will be evident from the following description having regard to the accompanying drawings, in which:

DETAILED DESCRIPTION OF THE INVENTION

Figure 1:
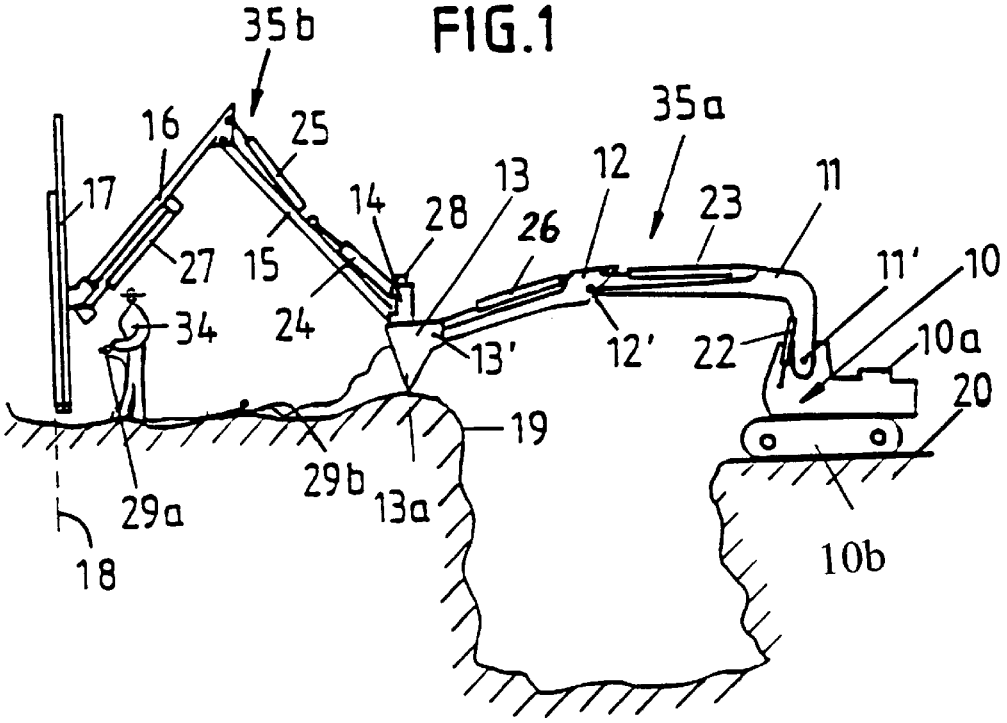
FIGS. 1–3 show schematically in side view the working boom, according to a first embodiment, having associated rock drilling equipment used at three different working locations.
Figure 9:
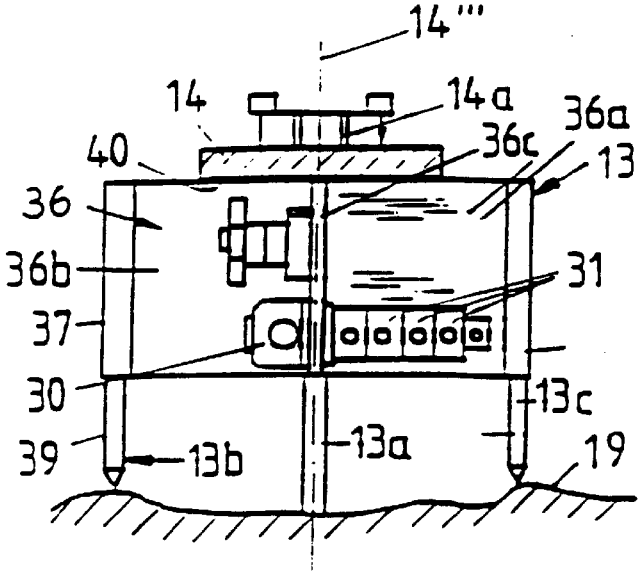

In FIG. 1 a working machine is shown in the form of a conventional excavating machine 10 having an associated pair of link arms 11 and 12, which form an inner portion 35*a* of a working boom 35. Outermost on the link arm 12 there is pivotally mounted a support member 13 having associated tapered foot parts 13*a*,13*b*,13*c* (FIG. 9). On the support member 13 there is pivotally mounted a carrier plate 14 for a pair of second link arms 15,16. The link arms 15,16 constitute according to a first embodiment a second outer portion 35*b* of the working boom 35. On brackets 14*a* on the carrier plate the link arm 15 is pivotally mounted. Outermost on the link arm 16 there is pivotally mounted a drilling equipment 17 for drilling a bore hole 18 in a mass 19 of rock.

During use the working machine 10 is adapted to be driven to a specific work location on a foundation 20 at a considerable distance from the working area of the drilling equipment 17, while the link arms 11,12 can be extended over a more or less inaccessible region 21 and foot parts 13*a*,13*b*,13*c* are clamped with a certain clamping force against a suitable foundation on top of the mass 19 of rock.

Figure 4:
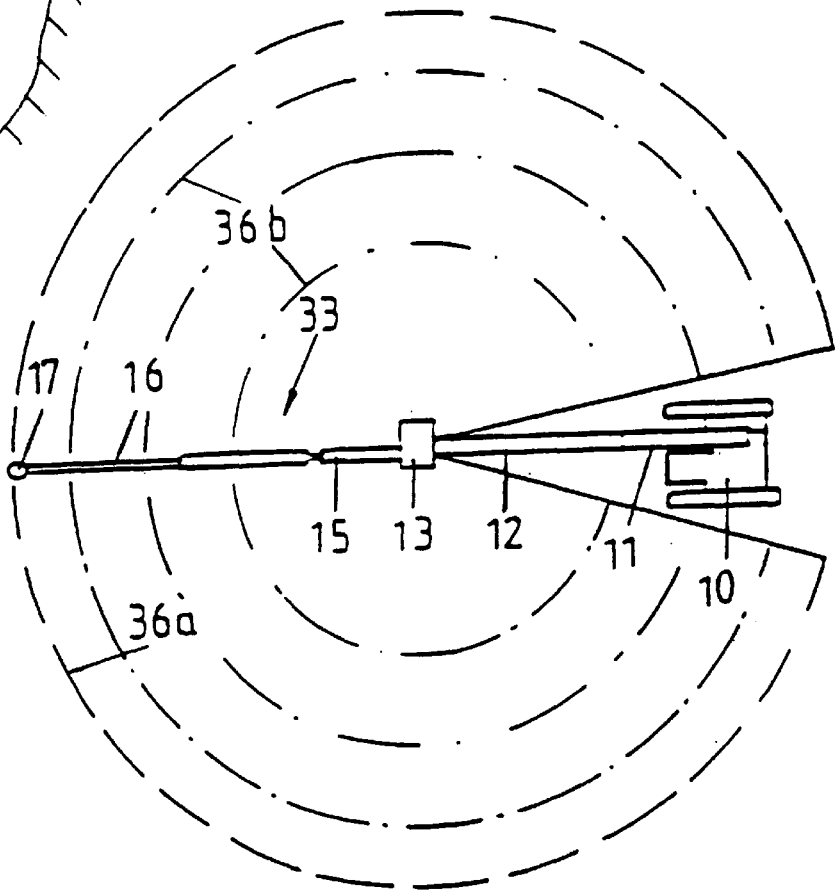
FIG. 4 shows in a plan view the working area of the working boom.

By means of the working machine 10 having associated link arms 11,12 the support member 13 can be positioned in a specific starting position for a specific working area, as is shown by broken lines 36*a* in FIG. 4. If necessary the support member 13 can be adjusted vertically or more or less obliquely relative to the foundation, all according to the conditions at the work location. Functionally the support member 13 is included in the first portion 35*a* of the working boom 35, while constructionally and manually it can be included in the second portion 35*b* of the working boom 35.

Figure 5:
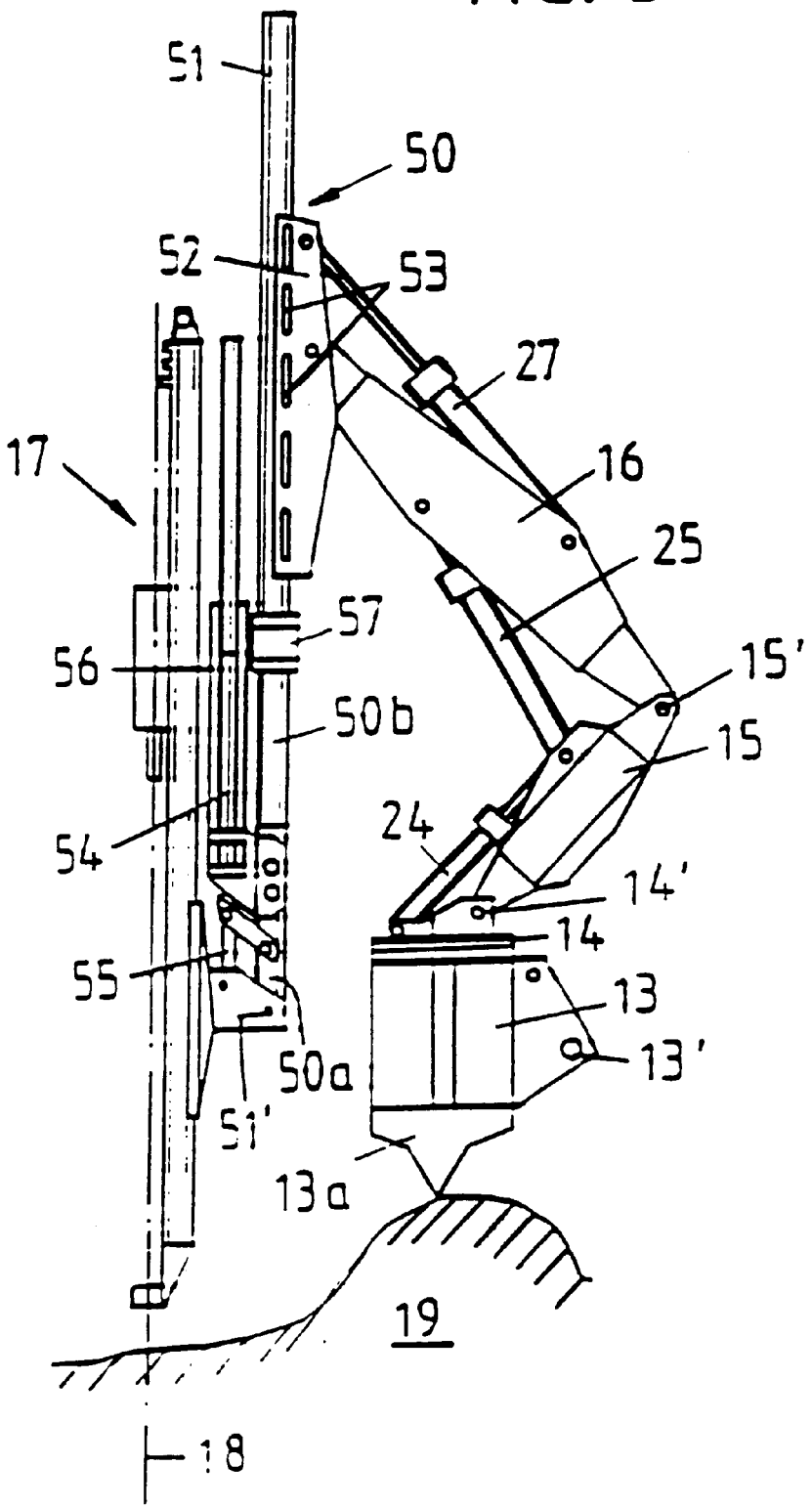
FIGS. 5–7 show in detail an outer part of the working boom according to a second embodiment, with the rock drilling equipment and a pair of associated link arms in different working positions.
Figure 6:
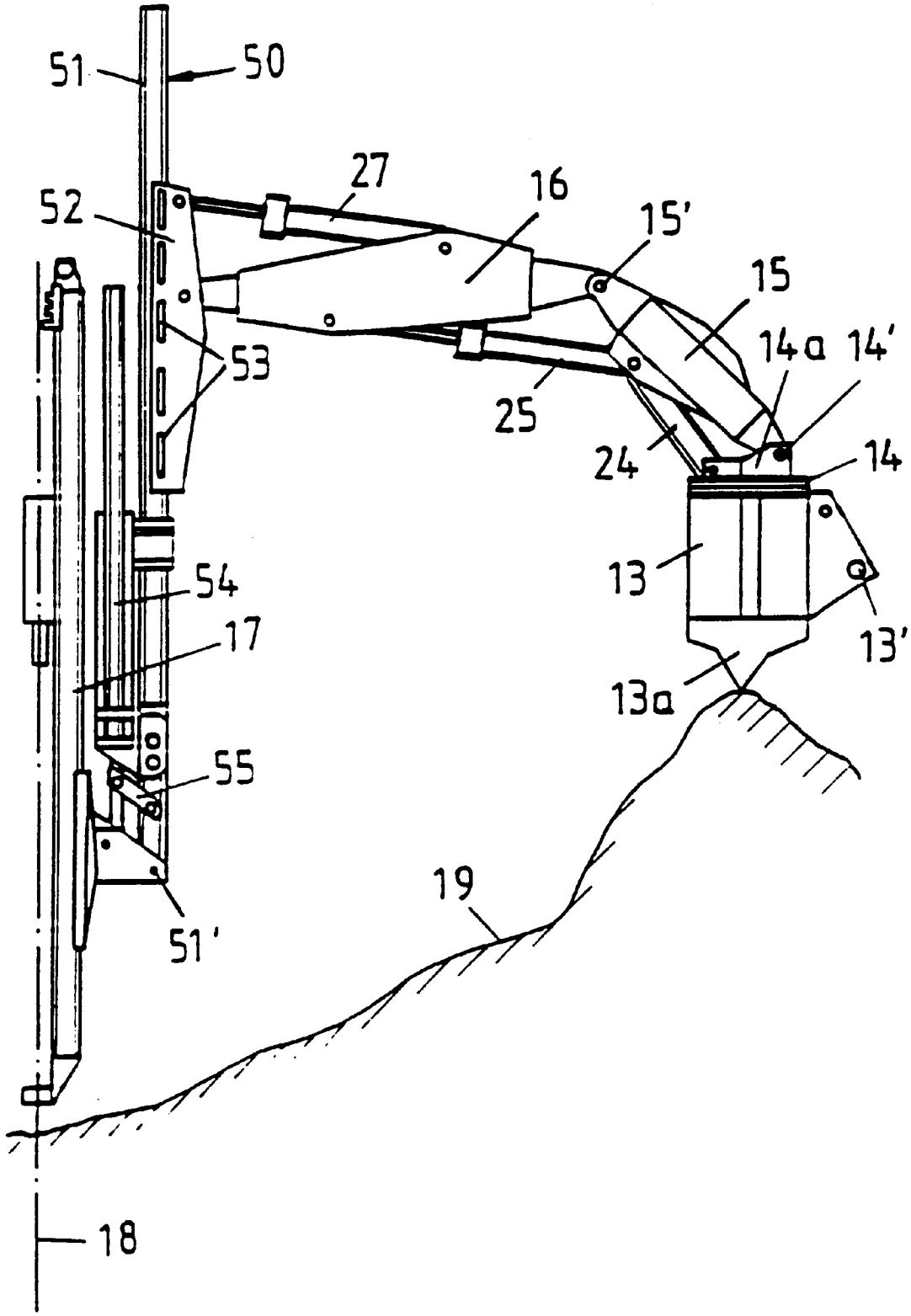

Thereafter the link arms 15,16 can as required and one after the other adjust the drilling equipment 17 to suitable distances from the support member 13 by swinging the link arms 15,16 about joint points 14',15',16' relative to the carrier plate 14 on the support member 13, as is indicated in FIGS. 5 and 6. It is possible to move the link arms 15,16 stepwise horizontally and/or vertically in a vertical plane through the link arms 15,16.

In addition the carrier plate 14 can be swung about a pivotal axis 14" (see FIG. 9) on the support member 13 for positioning the drilling equipment 17 in various positions along pivot arcs about the pivotal axis 14", as is indicated by chain lines 36*b* in FIG. 4. By adjusting the support member 13 into different oblique positions relative to the foundation, one can obtain instead of circular pivot arcs more or less ellipsoidal pivot arcs relative to the foundation, where conditions should dictate this. Alternatively by combined swinging of the second boom portion 35*b* about the axis 14" and swinging of the link arms 15,16 relative to each other the drilling equipment can move in more or less rectilinear paths across a plane through the inner portion 35*a* of the working boom 35.

Figure 7:
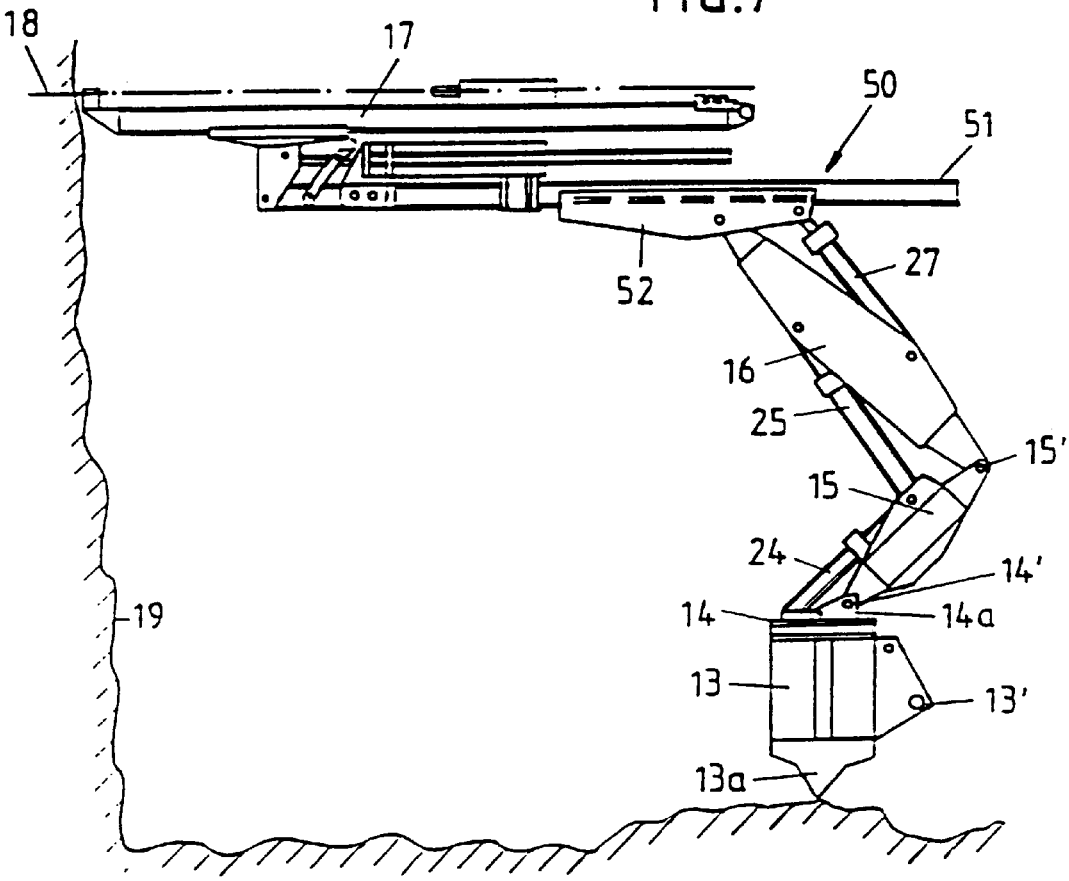

It is also possible to adjust the drilling equipment 17 into various positions relative to the horizontal plane, for example into a vertical position as shown in FIGS. 5 and 6 and into a horizontal position as shown in FIG. 7. Alternatively the drilling equipment 17 can be adjusted into various oblique positions relative to the vertical plane or relative to the horizontal plane.

Figure 8:
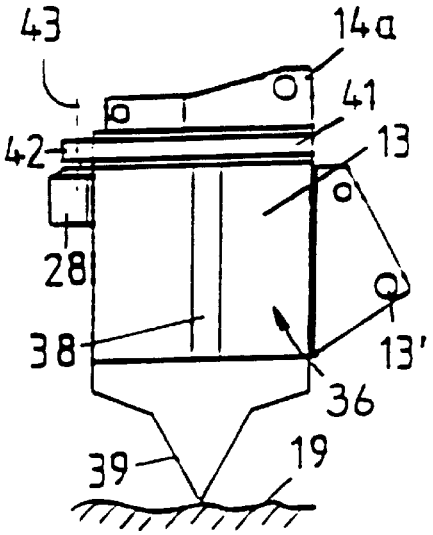
FIGS. 8–10 shows a support member in side view, plan view and vertical section respectively.
Figure 10:
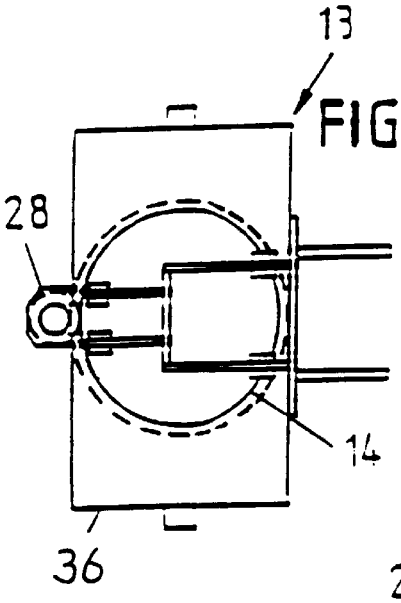

The swinging of the link arms 11,12 relative to the working machine 10 is undertaken by means of hydraulic pressure cylinders 22,23, while the swinging of the link arms 15,16 relative to the carrier plate 14 on the support member 13 is undertaken correspondingly by means of hydraulic pressure cylinders 24,25. Correspondingly the support member 13 is swung relative to the link arm 12 by means of a hydraulic pressure cylinder 26, while the drilling equipment 17 is swung relative to the link arm 16 by means of a hydraulic pressure cylinder 27. In addition the link arms 15,16 are swung via the carrier plate 14 relative to the support member 13 by means of a hydraulically driven motor 28. Hydraulic oil for operating the pressure cylinders 24,25,26,27 and the motor 28 is supplied, as is shown schematically in FIG. 11 from a separate hydraulic system 29, which is connected to drive means of the support member 13, as is shown in FIGS. 8–10. The hydraulic system 29 comprises a hydraulic motor 30 (see FIG. 11), which is driven by hydraulic oil, which is supplied from a pump 10' in the hydraulic system 10" of the working machine 10 via a rapid coupling 10'". By means of the motor 30 and a common drive shaft 30*a* a series of pumps 31 is driven, which forms a part of the hydraulic system 29 and which separately supplies hydraulic oil under a specific pressure to the various hydraulic components 24–28. Each pump 31 can by means of an associated solenoid valve 32 be regulated separately, with its separate working pressure and with its adapted quantity of hydraulic oil, adapted to the need for power of the individual hydraulically driven component.

The same hydraulic control system 29 is also employed for the supply of hydraulic oil for operating the drilling equipment 17. Alternatively the drilling equipment 17 can be driven by means of compressed air or in another known power-driven manner.

It is possible for a machine operator 34 to operate a panel 29*a* of the control system 29 from a position just by the drilling equipment 17 via a control cable 29*b*.

Figure 2:
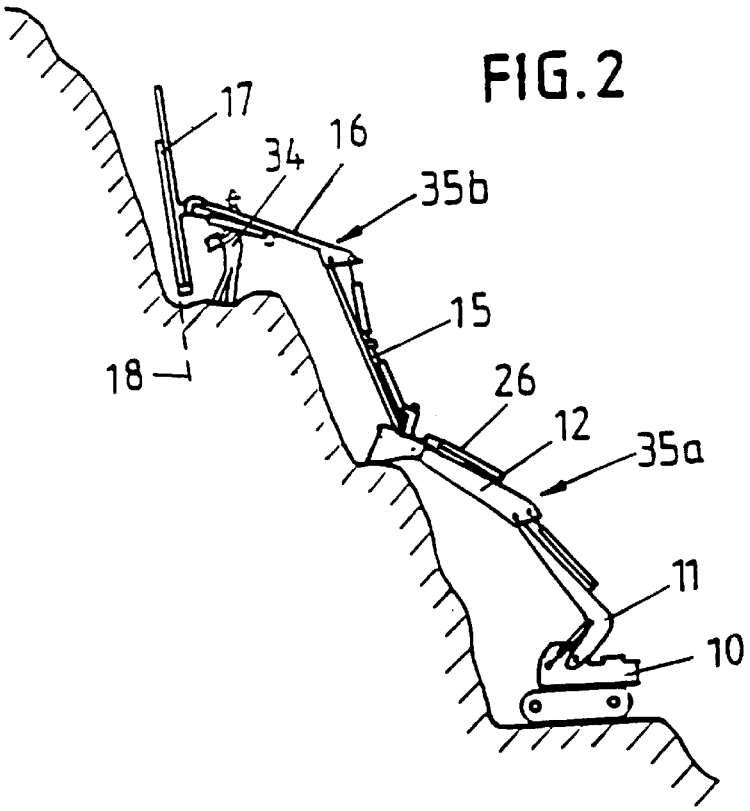
Figure 3:
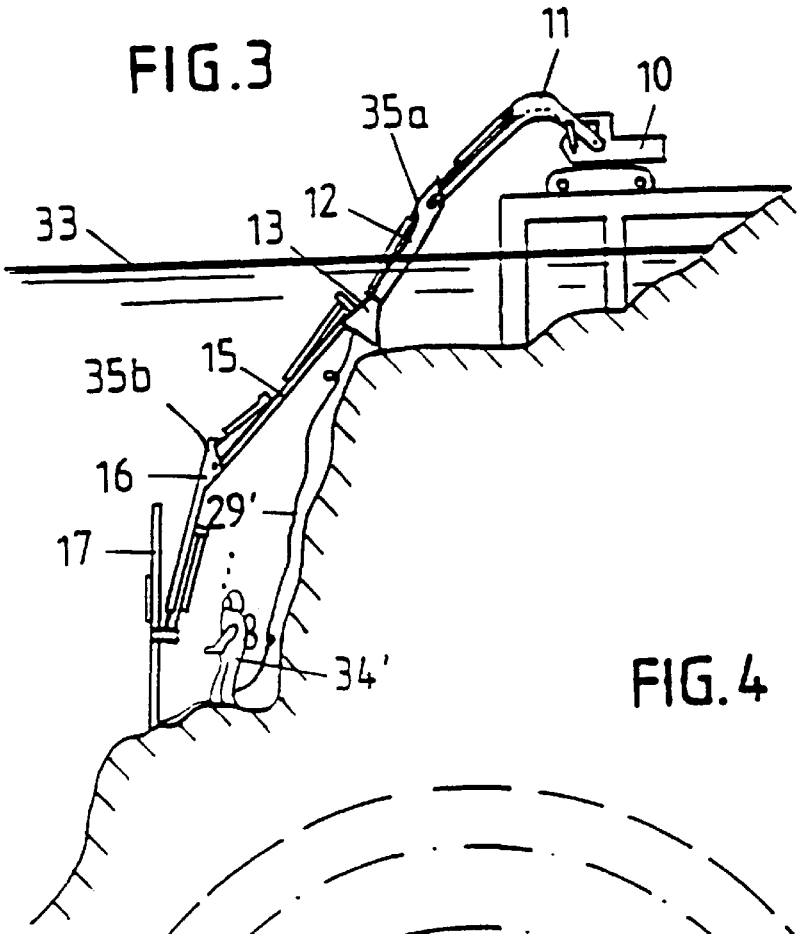

In FIG. 2 the arrangement according to the invention is shown schematically for drilling at higher levels than shown in FIG. 1, while in FIG. 3 the arrangement is shown for drilling at significantly lower levels than shown in FIG. 1. In FIG. 3 the arrangement is illustrated on using the drilling equipment 17 submerged at a level below a water/sea surface 33, controlled by a machine operator in the form of a diver 34'.

The arrangement according to the invention comprises a multi-linked working boom 35, which in the embodiment shown in FIGS. 1–4 is based on the four link arms 11,12, 15,16 and a further link member in the form of the middle support member 13 with associated carrier plate 14. In practice the working boom 35 comprises, as mentioned, a first, inner boom portion 35*a* and a second, outer boom portion 35*b*. the boom portion 35*a* comprises, as mentioned, functional link arms 11,12 and the support member 13. Constructionally the boom portion 35*a* comprises at the starting point only the link arms 11,12, since the support member 13 together with the carrier plate 14 forms a part of the second boom portion 35*b*. The support member 13 serves first and foremost as a base for the other, outer boom portion 35*b*, the support member 13 being able to form a steady, accurately controlled and separate anchor point supported against the foundation for the various work functions of the second boom portion 35*b*. The boom portion 35*b* comprises functionally the carrier plate 14 and the link arms 15,16, which jointly can adjust the drilling equipment 17 into various work positions relative to the support member 13.

At the starting point, the working boom 35 is adjustable, via a vertical rotary axis between upper machine part 10*a* of the working machine 10 and lower chassis part 10*b* of the working machine 10, into various horizontal angular positions relative to chassis part 10*b* of the working machine 10. From the working machine one can hereby choose a suitable placement of the support member 13 relative to the current working area for the second, outer boom portion 35*b*. The working boom 35 is adjustable, via a first joint axis 11' into various vertical angular positions relative to machine part 10*b* of the working machine 10, as is indicated in FIGS. 1–3. The link arm 12 is correspondingly adjustable into various vertical angular positions relative to the link arm 11 about a second joint axis 12', while the support member 13 is adjustable into various vertical angular positions relative to the link arm 12 about a third joint axis 13'.

In practice it is possible to design the outer boom portion 35*b*, including the support member 13, as a coherent, separate construction 35*b*,13, as is shown in FIGS. 5–7. Such a separate construction 35,13 is easy to couple to various current link arms 11,12 of the working machine, as required, by a simple mechanical coupling of the support member 13 with associated boom portion 35*b* to the outer link arm 12 and by a simple rapid coupling of the hydraulic system 10" of the working machine 10 to the hydraulic system 29 of the support member 13.

In FIGS. 5–7 the boom portion 35*b* is shown according to a second embodiment. In FIG. 5 the boom portion 35*b* is shown with the drilling equipment 17 in a working position relatively tightly up to the support member 13, while in FIG. 6 the same is shown at a remoter distance from the support member 13. During adjustment of the drilling equipment 17 into various working positions a certain, moderate moment is exerted in the support member and the bulk of this moment is relieved via the support member 13 to the ground. In the working positions shown in FIGS. 5 and 6 a minimal moment is exerted against the support member 13, since the weight of the drilling equipment is supported via the lower portion of the drilling equipment directly into the ground. In the working position illustrated in FIG. 7 the weight loading is mainly transferred from the boom portion 35*b* and the drilling equipment 17 via the support member 13 to the ground.

According to the second embodiment there is shown in addition to the two link arms 15 and 16 illustrated a third link arm 50, in the form of a feed beam, which has an axially regulatable length by regulatably clamping a longitudinal carrier beam 51 in a guide 52 via fastening means 53. The drilling equipment 17 is shown swingable about a pivotal axis 51' at the outer end of the carrier beam 51 in order to be able to permit adjustment of the drilling equipment 17 into various angular positions relative to a plane through the link arms 15,16,50. A hydraulically driven cylinder 54 is shown for readjusting a link arm mechanism 55 which controls the swinging of a bracket 56 which carries the drilling equipment 17. By means of the cylinder 54 the drilling equipment 17 can be locked in different angular positions about the axis 51'.

By means of the possibility of swinging of the drilling equipment 17 about the axis 51' relative to the link arm (the feed beam) 50 drilling can be permitted at different angles relative to the link arm 50, while the link arm 50 can be displaced telescopically relative to the link arm 16. In FIGS. 5–7 the drilling equipment 17 is shown in a position parallel to the link arm (the feed beam) 50. In FIG. 7 the drilling equipment is shown in a position for drilling horizontally, but on swinging about the pivotal axis 51' the drilling equipment 17 can be readily adjusted into a vertical position or into various other angular positions relative to the link arm (the feed beam) 50.

In the illustrated embodiment according to FIGS. 5–7 the beam 51 can be adjusted, for example mechanically, into various angular positions about the longitudinal axis of the beam 51 by turning an outer part 50*a* of the beam 50 relative to an inner part 50*b* of the beam 50. In this connection the cylinder 54 is fastened in a carrier member 56 which is pivotable together with the beam 50 via a sleeve 57 which is rotatably mounted on the inner part 50*b* of the beam.

In FIGS. 8–10 details are shown of the support member 13. The support member 13 is provided with a box-shaped housing part 36, which at the middle portion is provided with a middle support leg 13*b*. Two opposite support legs 13*a* and 13*c* are shown at opposite ends of the housing part 36. The middle support leg 13*b* has a stationary placement in the housing part 36, while the two remaining support legs 13*a* and 13*c* are separately axially displaceable by means of their respective hydraulic cylinders 37 (which are also connected to the control system 29 of the support member 13). Each of the support legs 13*a*–13*c* has a bar-shaped upper portion 38 and a foot portion 39 tapered in the lower part.

The housing part 36 is divided into two sections 36*a* and 36*b* with a dividing wall 36*c*. The one housing section 36*a* forms a hydraulic oil tank. In the hydraulic oil of the housing section 36*a* a number of pumps 31 are submerged, which supply hydraulic oil under separate pressures and in separate flow amounts to a respective hydraulically driven pressure cylinder or to a pair or a group of such pressure cylinders and to a respective hydraulically driven motor. The pumps are driven separately via a common drive shaft 30*a* from a hydraulically driven drive motor 30, which is common to all the pumps 31. The individual pumps 31 are coupled separately to the drive shaft 30*a* by means of respective solenoid valves 32. The solenoid valves are remotely controlled by the operator 32 via the control panel 29*a* and the associated control cable 29*b*.

Figure 11:
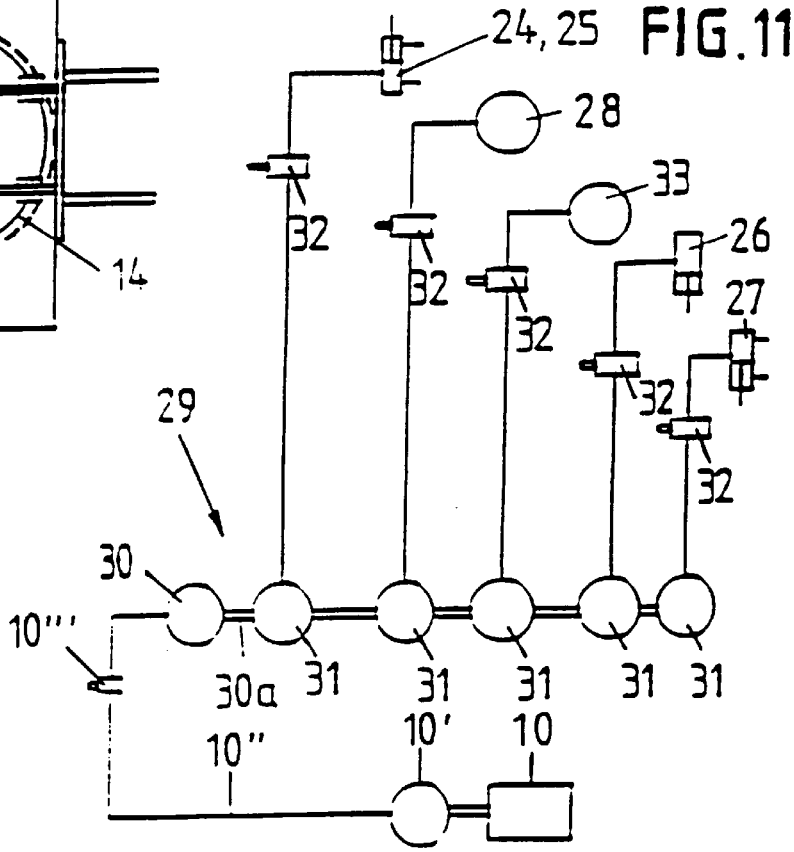
FIG. 11 shows schematically a coupling scheme for various components which form a part of the working boom according to the invention.

The drive motor 30 is received in the other housing section 36*b*, together with the solenoid valves 32 for the different pumps 31. The drive motor 30 is supplied with hydraulic oil under pressure directly from the hydraulic system of the working machine 10 via a rapid coupling 10''', as is indicated in FIG. 11.

A first disc-shaped bearing member 40 (see FIGS. 8–10), which is fixed to the top of the housing part 36 of the support member 13, carries via ball bearings a rotatably mounted carrier plate 14. The carrier plate 14 is surrounded by a gear rim 41 which stands in driving engagement with a gear rim 42 on a gear wheel 43 which is driven by the motor 28. The motor 28 is secured to one side face of the housing part 36.

In the illustrated embodiment the invention is illustrated in connection with a working tool in the form of drilling equipment 17. However the working boom 35 will also be used for other types of working tools, such as bolt fastening equipment, excavation equipment, etc., where the working tool shall work within a corresponding working area as shown in FIG. 4 on the basis of an intermittently fixed support member 13.

We claim:

1. Multi-linked working boom (35) for a working machine (10), where the boom (35) carries at the outer end a hydraulically manoeuvrable working tool, especially rock drilling equipment (17), and comprises a first pair of hydraulically manoeuvrable link arms (11,12), which are connected to the working machine (10) and a second pair of hydraulically manoeuvrable link arms (15,16) which jointably connect the working tool (17) to the first pair of link arms (11,12), wherein the second pair of link arms (15,16) is jointed to the first pair of link arms (11,12) via a link arm-forming support member (13), the support member (13) is provided with at least one stop part (13*a*,13*b*,13*c*) for intermittently fixing the support member (13) against an arbitrary support base by means of a tension force from the first pair of link arms (11,12), the second pair of link arms (15,16) is supported on a carrier plate (14) that is pivotally mounted on the support member (13) in two mutually crossing, vertical and horizontal pivotal planes relative to the first pair of link arms (11,12), and the support member (13) has a separate hydraulic system (29) including a hydraulic drive motor (30) for supplying hydraulic oil separately to the power means (24,28) of the support member (13).

2. Working boom in accordance with claim 1, wherein the second pair of link arms (15,16) is swingable relative to the support member (13) about two separate pivotal axes (14', 15') by means of their respective hydraulically driven power means (28,24), the support member (13) being in addition swingable relative to the first pair of link arms (11,12) about a third pivotal axis (13') by means of a hydraulically driven power means (26) in a first plane through the first pair of link arms (11,12), while the second pair of link arms (15,16) and the carrier plate (14) are swingable in pivot arcs in a second plane at right angles to the first plane, and the second pair of link arms (15,16) is mutually swingable in a third plane which crosses the second plane.

3. Working boom in accordance with claim 2, wherein the support member (13) is provided with a power means in the form of a drive motor (28) for turning the carrier plate (14) of the second pair of link arms (15,16) with associated working equipment (17) in the second plane relative to the first plane.

4. Working boom in accordance with one of the claims 1–3, wherein the separate hydraulic system (29) of the support member (13) supplies hydraulic oil separately to the power means (24, 28) between the support member (13) and the carrier plate (14) and the one link arm (15) of the second pair of link arms and separately to the power means (25, 27) mutually between the link arms (15, 16) of the second pair of link arms and between the outer link arm (16) and the working equipment (17), wherein the hydraulic drive motor (30) is driven by hydraulic system (10''') of the working machine (10), while the power means (24, 28 and 25, 27) are driven by the drive motor (30) via separate hydraulic circuits with associated separately operable pumps (31).

5. Working boom in accordance with claim 1, wherein the working boom (36) is formed in the use position by a first, inner stationary boom portion (36*a*), which comprises the link arms (11,12) of the first pair of link arms plus the support member (13), and a second, outer, movable boom portion (36*b*), which comprises the carrier plate (14) and the link arms (15,16) of the second pair of link arms, the second boom portion (36*b*) forming a moveable support and carrier part of the working equipment (17), while the first boom portion (36*a*) forms a stationary support and carrier part of the second boom portion (36*b*).

6. Working boom in accordance with one of the claims 1–5, wherein the support member (13), the carrier plate 14 and the second pair of link arms (15, 16) with associated working tool drilling equipment (17) are releasably coupled to link arms (11 or 12), of the working machine (10).

7. Working boom in accordance with one of claims 1–6, wherein the separate hydraulic system (29) of the support member (13) further supplies hydraulic oil separately to a power means for operating the drilling equipment (17), which is driven by the drive motor (30).

* * * * *